United States Patent [19]

Gustavsson

[11] 4,131,059

[45] Dec. 26, 1978

[54] APPARATUS FOR FORMING AND CONTROLLING CURRENTS OF AIR

[75] Inventor: Lennart Gustavsson, Vaxjo, Sweden

[73] Assignee: AB Svenska Flaktfabriken, Nacka, Sweden

[21] Appl. No.: 773,758

[22] Filed: Mar. 2, 1977

[30] Foreign Application Priority Data

Mar. 5, 1976 [DE] Fed. Rep. of Germany ..... 2609030

[51] Int. Cl.[2] ..... F24F 9/00

[52] U.S. Cl. ..... 98/36; 98/40 D

[58] Field of Search ..... 98/36, 40 D, 40 N, 33 R, 98/115 S, 115 B

[56] References Cited

U.S. PATENT DOCUMENTS 3,358,577 12/1967 Thomson ..... 98/40 D

*Primary Examiner*—William E. Wayner

*Attorney, Agent, or Firm*—Howson and Howson

[57] ABSTRACT

Apparatus for forming and controlling high-velocity air curtains in a room such as an auto-body painting booth, which room is also provided with ventilating air flowing inwardly through perforations in a ceiling in response to pressure developed by a fan in a chamber above the ceiling. Rather than using a permanent custom-designed arrangement of nozzles separately supplied with pressurized air through special ducts to form the air curtains, the curtains are formed and controlled by air guiding means located on the room side of the ceiling and open to the ceiling perforations, so configured that the flow through the perforations is converted to one or more air curtains of desired velocity and direction. Quick-disconnect fastening means insertable into the perforations through a flange on the air guiding means enables installation, removal or shifting of theair guiding means, as desired for different purposes. The air guiding means may be a duct of generally rectangular cross section open on one side to the ceiling perforations, with restricted openings on another side serving as nozzles, and adjustable plates may be provided in the duct to permit adjustment of air-current flow.

11 Claims, 9 Drawing Figures

APPARATUS FOR FORMING AND CONTROLLING CURRENTS OF AIR

BACKGROUND OF THE INVENTION

The invention relates to apparatus for forming and controlling air currents, especially air currents issuing from an air-permeable perforate surface.

In buildings and in plants of widely varying kinds and used for a wide variety of purposes, for example in plants for the spray-painting of the bodywork of cars, it is known to supply fresh air to an enclosed space through a perforated surface, preferably through the ceiling of a room. For this purpose there is generally provided a cavity, positioned behind or above the perforated surface, to which a fan or blower is connected. The fresh air so supplied issues from the perforated surface opposite the cavity in a relatively uniform array of numerous low-velocity air currents which may, for example, carry particles of dyestuff, paint, gases, solvents or other contaminating or air-polluting matter through the room, to leave it through outlets which are usually provided in the room surface opposite the perforated surface, e.g. in the floor.

Ventilating systems of this kind are, on the whole, quite useful; they have, however various serious disadvantages. For example, systems of this kind are generally incapable of allowing for the fact that the optimum quantity and optimum velocity of the ventilating air are different in various parts of a room. Instead, the entire system is adjusted to supply the requirements of the particular area of the room most in need of ventilation. However, the ventilating air supplied in cold and moderate climatic regions is generally heated, and considerable losses of energy thus result from the fact that the maximum quantity of heated ventilating air also circulates through areas of the room which are less in need of ventilation. In addition, problems may arise from drafts obtaining in certain zones of the room.

These disadvantages have not remained unnoticed. Thus, for example, it is proposed in French Pat. Specification No. 2,107,262 to improve the air circulation by dividing a ceiling into various sections of ventilation, each section serving a different purpose. In accordance with that French patent specification, a central section of the ceiling is provided with uniformly spaced perforations ensuring uniform circulation through a central section of a room, the central section of the ceiling being surrounded by channels which, through continuous gaps, produce so-called "air curtains" for the purpose of screening the central section of the room.

Such an arrangement is not only highly specialized, in that it is intended for use only in very special cases, but it is also very expensive since it requires the provision of separate air inlets for each individual other section of the ceiling. An exact adjustment of the air-curtain flow in various areas of the ceiling is very difficult, even impracticable, since a considerable pressure drop has to be expected owing to the lengths of the individual channels or ducts. For these and other reasons, such known system cannot be considered to be suitable to solve the afore-mentioned problems, except in a few special cases.

Copending application Ser. No. 615,971 of George Walker, filed Sept. 19, 1975, now U.S. Pat No. 4,048,912 and entitled "Colour Spray Booth and Method for Ventilating the Same" describes an air ventilating system in which ventilating air currents are caused to flow downward through a perforated ceiling to exit through openings in a floor, while at the same time separate air ducts supply air under pressure to one or more arrays of nozzles or the like which provide air curtains for separating the room into differently-ventilated areas. While suitable for many purposes, this system is again somewhat expensive, and once installed, rather difficult to rearrange to accommodate changes in desired operating characteristics.

It is therefore an object of the invention to provide a simple and inexpensive apparatus for forming and controlling air currents issuing from a perforate surface into a region in which changed requirements can be quickly and fully met and the invention applied in widely varying fields and to various extents by virtue of its high flexibility of construction and adjustability.

SUMMARY OF THE INVENTION

According to the invention, this object is achieved by apparatus comprising perforate partition means adjacent a region such as a room in which the air currents are to be formed, air-moving means such as a fan on the opposite side of the partition means from said region for pressurizing air on said opposite side to force currents of air through the perforate partition means into said region, in combination with air guiding means on the side of said partition means adjacent said region and covering a perforate portion of the partition means for receiving said air currents from the perforations and modifying their flow into said region.

Preferably the air guiding means is a generally rectangularly cross-sectioned duct having an open side against the ceiling with restricted openings in another side thereof for forming curtains of high velocity air in the region or room. The air-guiding means may have one or more outwardly-projecting flanges for fastening the air guiding means to the partition means, preferably by quick-disconnect fasteners insertable into the perforations in the partition means. The restricted openings may be in the form of one or more nozzles, preferably formed by spaced-apart extensions of the walls of the air guiding means. The nozzles may be hinged to permit adjustment of their angular orientation, and adjustably pivotable or translatable plate means may be postponed in the air guide means to adjust the velocity and/or quantity of air flow.

BRIEF DESCRIPTION OF FIGURES

Further features and advantages of the invention will be more readily understood with reference to the following detailed description and the accompanying drawings, in which.

Figure 3:
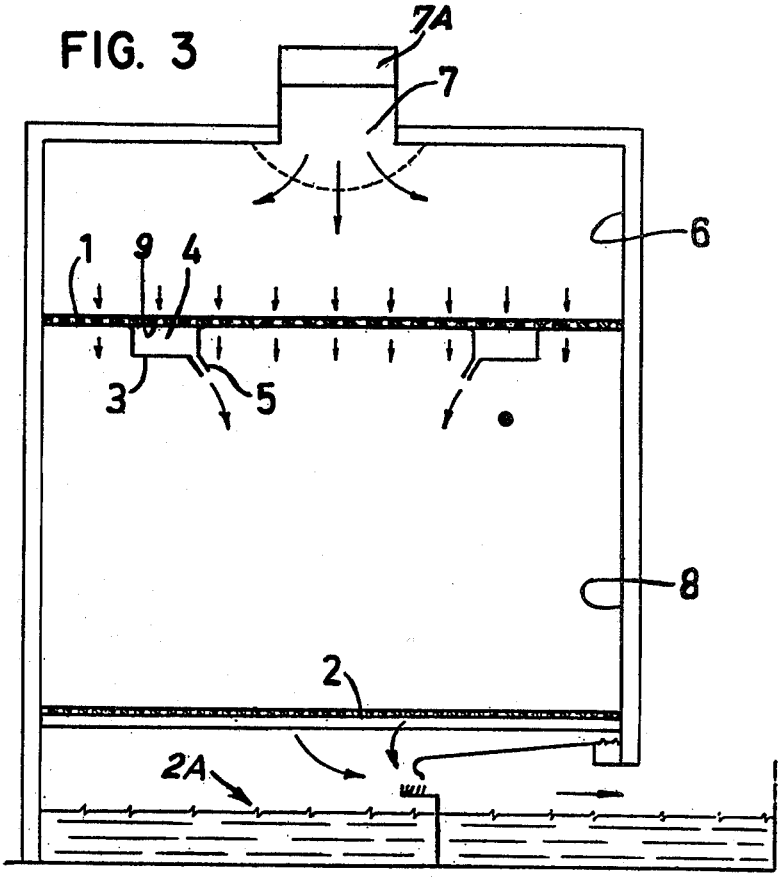
FIG. 3 is a schematic cross-sectional view of a practical application of apparatus illustrated in FIGS. 1 and 2.

Referring to the drawings, the reference numeral 1 designates a permeable partition means, for example a perforate internal ceiling of a room 8 (FIG. 3). A cavity 6, to which ventilating air is supplied through an inlet 7 by a fan 7A, is provided at a position behind or above the perforate ceiling 1. The ventilating air may be tempered (that is, the temperature of the ventilating air may be adjusted) either in or enroute to the cavity 6. The ventilating air undergoes a certain pressure drop as it passes through the ceiling 1. It issues from the ceiling 1 into the region on the room side thereof as a plurality of small air currents to low velocity, for example of a velocity of 0.35 m/sec. The air then circulates through the room 8 before leaving it at a desired position, for example through a perforated floor or bottom 2 where the velocity of the ventilating air may amount to 0.2 m/sec. as in the case of one practical embodiment. In this manner a uniform circulation of the ventilating air through the whole room 8 is ensured. A conventional purifying bath arrangement 2A may be provided beneath the floor, to remove contaminants from the air.

In accordance with the invention, air guiding elements or deflectors 3 are provided on the room side of the perforate surface 1. In one preferred embodiment, the air guiding elements are box-shaped having, for example, the form of elongated, or oblong flat boxes made of steel plate and of rectangular cross section. One large side of each air guiding element is open, and it is this open side 9 of the guiding element which is secured to the perforate surface 1. The open side of the guide element is surrounded by an outwardly projecting circumferential flange 10. The flange 10 may be provided with suitable attaching means, for example holes for the insertion of screws, clamps or the like. The air guiding elements or deflectors according to the invention may particularly advantageously be provided with rapid-fastening, quick-disconnect elements such as 10A adapted to cooperate, for example, with the holes in the flange and the perforations 10B in the surface 1. Rapid-fastening, quick-disconnect devices of widely varying constructions are well known, and thus need not be described in detail. These elements facilitate quick dismantling and assembly, frequently without the use of tools of any kind. Furthermore, a packing, for example a circumferential packing or sealing strip, secured to the flange 10 may be provided in this zone, if required.

In one form of construction according to the invention, the open side 9 of the air guiding means 3 may be closed. When a determined pressure in the interior 4 of the box is reached, any further flow through this section of the surface is thus prevented with the result that a substantially flow-less area is formed below the guide element.

Figure 1:
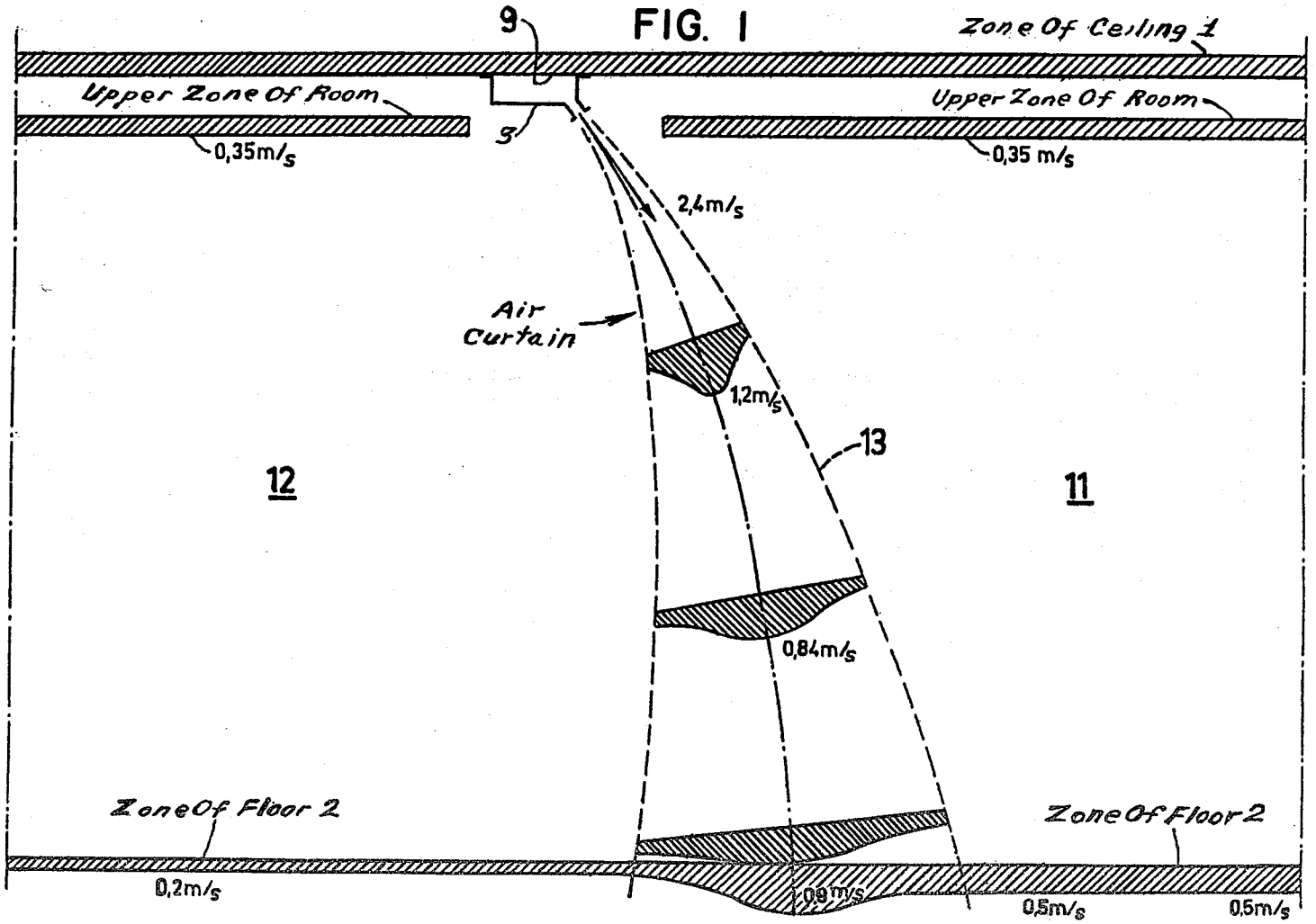
FIG. 1 shows schematically a side elevational view of one form of air guiding means according to the invention for conducting air currents issuing from a perforated surface, together with diagonally-hatched areas illustrating the velocities of air flow in various regions.
Figure 2:
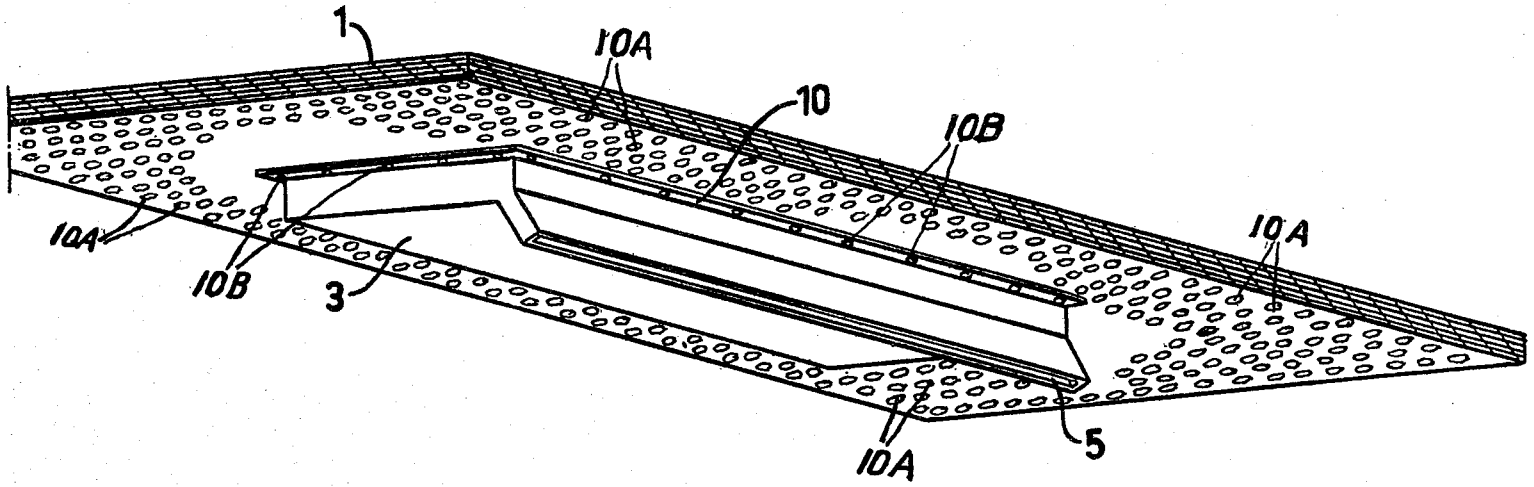
FIG. 2 is a perspective view from below of the apparatus shown in FIG. 1, in position on a ceiling.
Figure 9:
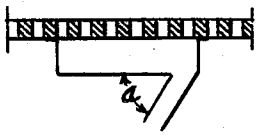
FIGS. 4 to 8 are schematic cross-sectional views of various modified embodiments of apparatus according to the invention for guiding air currents issuing from a perforated surface and FIG. 9 shows a specific preferred embodiment of the invention.

In a preferred form of construction, air guiding means 3 is provided with an outlet 5 in the form of a nozzle or the like which, in one practical embodiment which is shown in FIGS. 1 to 3, is located along one of the longitudinal edges of air guiding means 3, which edge is remote from the open side 9 of the air guiding means. The nozzle 5 may be produced by extending two adjacent edges of the air guiding means in a suitable direction, while maintaining them spaced apart (see FIG. 2). In this construction, the nozzle preferably extends at an angle downwards, preferably at an angle of about 50°-80° or 100°-130° to the surface 1. FIG. 9 shows a preferred embodiment of the invention in which this angle a is about 65°.

The construction hereinbefore described has the following effect. The relatively large open side 9 of the air guiding box 3 covers a relatively large surface area of the perforated surface 1, and thus intercepts the ventilating air issuing from that section of the perforated surface. The pressure in the cavity 6 causes the pressure in the interior 4 of the box to rise with the result that a predetermined portion of the entrapped air flows out through the nozzle 5 at a considerable higher velocity, normally at a multiple of the original velocity, for example at a velocity of about 2.4 m/sec. In this embodiment, the nozzle is relatively long and narrow so that an air curtain 13, illustrated by way of example in FIG. 1, is produced. It will be understood that a plurality of guide elements may be provided in series so that the room may thereby be subdivided into two sections, for example, by a continuous curtain of this kind. Downwardly sloping nozzles produce the phenomenon that the cross-section of one part or zone 11 of the room decreases downwardly, while the cross-section of the other part 12 of the room on the other side of the air curtain increases downwardly. The fact that the ventilating air enters the room 8 through the surface 1 at a uniform pressure, and thus also at a uniform velocity, means that the proportional outlet zone 2 available to room section 11 is considerably smaller than its perforated air-inlet surface; exactly the reverse conditions obtaining in room section 12. The dynamic pressure of the air curtain 13 prevents equalization of pressure between the two zones of the room. As a result, the static pressure in room section 11 increases to deflect the air curtain 13 increasingly in the direction of room section 12 with increasing distance from the nozzle 5. Reference is now made to FIG. 1, wherein the vertical height of the diagonally-hatched regions indicates the air flow velocity in that zone. In one practical embodiment, the air intake velocity in the zone of the surface 1 amounts to 0.35 m/sec., the air outlet velocity in the zone of surface 2 in room section 12 amounts to 0.2 m/sec. and in room section 11 to 0.5 m/sec., while the velocity Vo of the air curtain drops from 2.4 m/sec. to 1.2 m/sec. at a higher level and from 0.84 m/sec. at a lower level to 0.9 m/sec. in the zone of outlet surface 2.

This embodiment is suitable for a very wide field of applications. Thus, for example, zone 11 may be used for subjecting a product to a certain treatment, such as spray painting, while zone 12 may then be occupied by persons or used for some other purpose involving less or no pollution of the air and thus requiring less air circulation.

In one embodiment, which is illustrated in FIG. 3, the air guiding elements 3 may be provided, for example, in two opposed, spaced series resulting in the formation of two zones with less air circulation at the edges and a central zone with a considerably stronger air circulation.

It will be understood that the nozzle 5 may have any of a variety of shapes and may point in any of a variety of directions. This is shown for example in FIGS. 6 and 7. In this respect it may be mentioned that the nozzle may even extend in a direction parallel to the surface 1, so that only weak or no downwardly directed air currents are obtained below the zone close to the nozzle, while the downwardly directed air currents increase in intensity with increasing distance from the nozzle.

It will be readily understood that the invention constitutes a large step forward in the art because it facilitates the conducting or guiding of the emergent air currents from the partition means in virtually any desired direction. The assembly and dismantling of the air guiding elements present no difficulty, and they may be fitted at any position on the perforate surface 1. There is the considerable advantage that special systems for producing the currents of air injected into the room are dispensed with, since the available air currents of low velocity are in a surprisingly advantageous manner converted into air currents of a higher velocity. The resistance offered by the air guiding elements according to the invention results simultaneously in a reduced total air flow, which can be further reduced by the total screening of sections of the perforate surface. The drawings show that the total flow of air may also be reduced when the air curtain 13 extends at an angle. In this way, a certain general saving is obtained, particularly as far as the costs for heating the air supply are concerned, while, on the other hand, the invention makes it possible for zones through which the air circulates at a relatively low rate to be created at exactly the positions desired. This means that, by virtue of the invention, it is now no longer necessary to start from an average circulation rate meeting maximum requirements as having to be met, for example, in a zone in which a product is treated, since, owing to the possibilities of air directing and distributing afforded by the invention, it is now possible to start from a substantially lower rate of circulation which, thanks to the invention, may be conveniently increased at those positions where a stronger circulation of the air is required.

Figure 4:
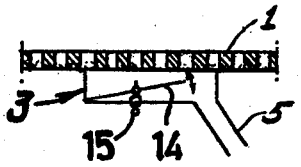

FIGS. 4 to 8 show further possibilities of adjustment and construction. In FIG. 4 an adjusting plate 14 is provided one edge of which plate is arranged and pivotably secured in the interior of an air guiding element 3 at a position close to the bottom thereof. An adjusting screw 15 or the like, provided centrally in the bottom of the air guiding element, acts upon the central area of the plate 14 the free edge of which can thus be moved to and fro in the direction towards and away from the perforate surface 1 with the result that the perforate surface 1 screened by the guide element is screened either totally or partially, or a kind of pressure lock is formed by which the quantity and velocity of the air issuing from the nozzle 5 are reduced, that is to say, when the plate 14 is in the raised position.

Figure 5:
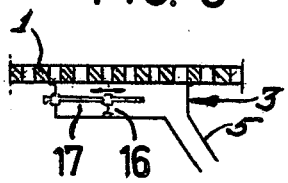

A similar construction is shown in FIG. 5, in which a screening plate or shield 16 is movable to and fro parallel to the perforated surface 1 in the direction towards and away from the nozzle. This translational displacement is brought about by a setscrew 17 to increase or reduce the collecting volumn connected to the nozzle 5 according to the position of the plate 16, with the result that the air current issuing from the nozzle 5 is conveniently controlled.

Figure 6:
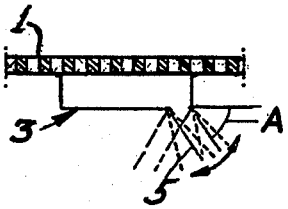

As indicated in FIG. 6, a hinged or pivoted nozzle 5 is provided using a hingecoupling of known construction or any other known means. Best results have been obtained when direction of the nozzle is between 50° and 80°, or between 100° and 130° with respect to the room-side surface of the partition means.

Figure 7:
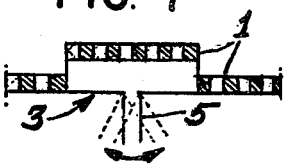

This also applies to the embodiment illustrated in FIG. 7, in which the nozzle 5 is arranged centrally below a box-like air guiding element. The air guiding element in this construction may be embedded in the perforated surface 1 as shown in the drawing.

Figure 8:
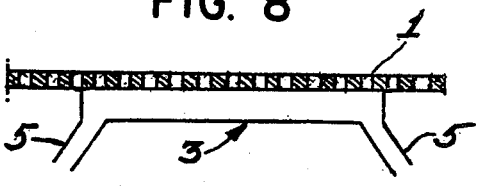

FIG. 8, finally, shows a unit comprising two nozzles 5 and 5A in which one nozzle is respectively provided at each of two opposed lateral edges of the box-like air guiding element.

The constructions hereinbefore described and illustrated in the drawings are given merely by way of example, that is to say, the disclosure of the invention is not restricted to these constructions, optional modifications and additions being possible within the scope of the invention and within the frame-work of the following claims. Thus, for example, the invention is not limited to rectangularly cross-sectional guide elements, although this is generally the most advantageous form to use. The construction of the nozzle 5 may be varied within wide limits. Thus the reference to "nozzle" herein includes any air outlet, such as perforations, provided on the underside of an air guiding element. The type of perforation used in the air guiding element may be different from that provided in the perforate surface 1. In this way, the desired variety of intensity of circulation in different parts of a room may be obtained.

What is claimed is:

1. Apparatus for forming and controlling currents of air in a region, comprising:

perforate partition means adjacent said region;

air-moving means on the opposite side of said partition means from said region for pressurizing air on said opposite side to force currents of air through said perforate partition means into said region; and box-like air guiding means adjacent said region and covering a perforate portion of said partition means, for receiving said air currents and concentrating their flow in a particular part of said region, said air guiding means being open on one side to said perforate portion of said partition means to receive said air currents and sealed about its periphery to said partition means, said air guiding means comprising one or more restricted openings to said region and being open substantially only to said perforate portion of said partition means and at said restricted openings, thereby to form from said received air currents at least one curtain a higher-velocity air directed into said region.

2. The apparatus of claim 1, wherein said air guiding means is generally rectangular in cross section, one side thereof being open and positioned against said perforate portion of said partition means.

3. The apparatus of claim 2, wherein said air guiding means comprises outwardly-projecting peripheral flange means and means for securing said flange means to said perforate partition means.

4. The apparatus of claim 3, wherein said securing means comprises quick-disconnect fasteners cooperable with said flange means and said perforations in said partition means for securing said air guiding means to said partition means.

5. The apparatus of claim 1, wherein at least one of said restricted openings is in the form of a nozzle.

6. The apparatus of claim 5, wherein said air guiding means is generally rectangular in cross section, and said nozzle is formed by spaced-apart extensions of two adjacent sides of said air guiding means.

7. The apparatus of claim 5, wherein the angle between the direction of said nozzle and said side of said partition means differs from 90° by from about 10° to about 40°.

8. Apparatus according to claim 7 wherein said nozzle is mounted pivotably to permit adjustment of its angle with respect to said partition means.

9. Apparatus according to claim 1, comprising adjustable air-flow controlling means in said air guiding means for adjusting the velocity, or quantity, of air flow, or both, in said air curtain.

10. Apparatus according to claim 9, wherein said adjustable air-flow controlling means comprises a pivotable damper plate in said air guiding means and screw means for adjusting the angular position of said plate.

11. Apparatus according to claim 9, wherein said adjustable air-flow controlling means comprises a plate within said air guiding means extending transversely to said partition means and screw means for adjusting the position of said plate along a direction generally parallel to said partition means.

* * * * *